US006935493B2

(12) United States Patent
Cho

(10) Patent No.: US 6,935,493 B2
(45) Date of Patent: Aug. 30, 2005

(54) CAP DEVICE FOR MIXING DIFFERENT KINDS OF MATERIALS SEPARATELY CONTAINED THEREIN AND IN BOTTLE

(76) Inventor: Young Kook Cho, 3090 E. 50th St., Vernon, CA (US) 90052

( * ) Notice: Subject to any disclaimer, the term of this patent is extended or adjusted under 35 U.S.C. 154(b) by 111 days.

(21) Appl. No.: 10/687,043

(22) Filed: Oct. 17, 2003

(65) Prior Publication Data

US 2004/0200742 A1 Oct. 14, 2004

(30) Foreign Application Priority Data

Apr. 12, 2003 (KR) ..... 10-2003-0023243

(51) Int. Cl.[7] ..... B65D 25/08; B67D 5/00

(52) U.S. Cl. ..... 206/222; 215/DIG. 8; 222/83

(58) Field of Search ..... 206/219–222, 206/568; 222/83, 129; 215/DIG. 8, 250, 253, 257

(56) References Cited

U.S. PATENT DOCUMENTS 1,464,273 A * 8/1923 Schopflocher ..... 206/219
2,653,609 A * 9/1953 Smith ..... 604/416
3,156,369 A * 11/1964 Bowes et al. ..... 206/222
3,339,802 A * 9/1967 Weiner et al. ..... 222/82
3,548,562 A * 12/1970 Schwartzman ..... 53/440
3,684,136 A * 8/1972 Baumann ..... 222/386
4,502,604 A * 3/1985 Martus ..... 215/206
5,342,346 A * 8/1994 Honda et al. ..... 604/413
5,433,328 A * 7/1995 Baron et al. ..... 215/11.4
6,152,296 A * 11/2000 Shih ..... 206/222
6,364,103 B1 * 4/2002 Sergio et al. ..... 206/222
6,527,110 B2 * 3/2003 Moscovitz ..... 206/222

* cited by examiner

*Primary Examiner*—Jila M. Mohandesi
(74) *Attorney, Agent, or Firm*—Jerry H. Noh

(57) ABSTRACT

A cap device for bottles, which is capable of mixing two different additives separately contained therein with a material contained in a bottle to prepare a mixture in accordance with a simple rotating action of the cap device relative to the bottle, performed by a user, thus allowing the user to easily prepare the mixture just before drinking or using the mixture. The cap device has a cap cover acting as an additive containing part, and defining a cavity therein, with a partition wall provided in the cavity to divide the cavity into two chambers and to separately contain two different additives in the chambers; a first funnel part provided at a lower section of the cap cover; a breakable sheet having a structure to be easily broken by external impact provided at an open lower end of the first funnel part to close the open lower end of the first funnel part; a cap body assembled with a lower end of the cap cover externally tightened to an externally threaded mouth of a bottle; a second funnel part having the same shape as the first funnel part provided at an upper section of the cap body, such that the first and second funnel parts are spaced apart from each other or come into contact with each other; and a means for breaking the breakable sheet so as to open the lower end of the first funnel part.

8 Claims, 3 Drawing Sheets

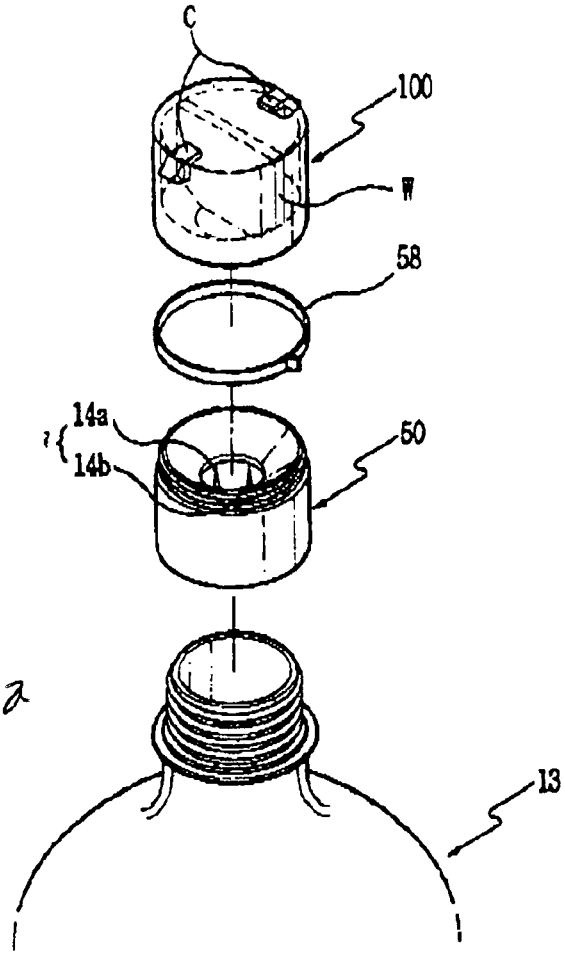
FIG. 1a
FIG. 1b.
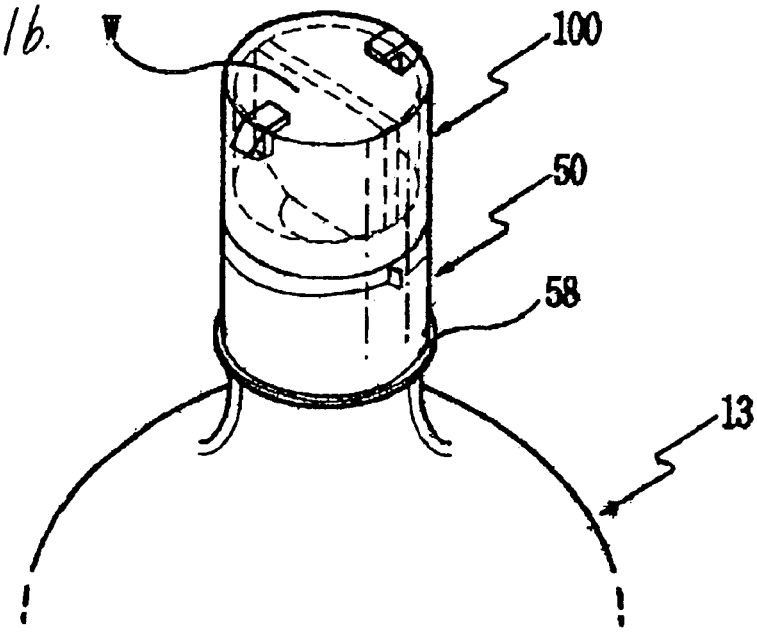

CAP DEVICE FOR MIXING DIFFERENT KINDS OF MATERIALS SEPARATELY CONTAINED THEREIN AND IN BOTTLE

BACKGROUND OF THE INVENTION

1. Field of the Invention

The present invention relates, in general, to caps for bottles which contain a variety of materials, such as drinks, liquid medicines or liquid chemicals, therein and, more particularly, to a cap device for such bottles, which is capable of mixing an additive contained therein with a material contained in a bottle to prepare a mixture in accordance with a simple rotating action of the cap device relative to the bottle, performed by a user, thus allowing the user to easily prepare the mixture just before drinking or using the mixture.

2. Description of the Related Art

In the prior art, most of conventional disposable bottles circulated and sold in markets each contain therein only a single kind of material, such as a drink a liquid medicine or a liquid chemical, and are closed by caps at the mouths thereof. When a user wants to add an additive to the material contained in such a capped bottle so as to prepare a mixture prior to drinking or using the mixture, the user must add the additive from a separate container to the bottled material after removing a cap from the bottle. Therefore, it is necessary for manufacturers of the additives and the bottled materials to separately contain such additives and materials in separate containers and bottles prior to marketing them, thus undesirably wasting natural resources due to the production of the separate containers and capped bottles. In addition, the adding of the additive from the separate container to the bottled material to mix them after removing the cap from the bottle is inconvenient to the user, because the user is forced to separately purchase and handle the additive container and the bottle.

Furthermore, it is extremely difficult for the user to add a precise amount of the additive from the separate container to the material contained in the bottle, and so the user roughly measures the amount of the additive to be added to the bottled material. Therefore, in the case of mixing an additive with a bottled drink to produce a mixed beverage, the rough measurement of the amount of the additive may result in a change in the taste and quality of the mixed beverage. In the case of mixing an additive with a bottled liquid medicine or a bottled liquid chemical to produce a mixed medicine or a mixed chemical, the rough measurement of the amount of the additive may result in incomplete dissolution of effective ingredients of the additive in the medicine or the chemical and a failure of accomplishment of desired medical or chemical effects of the mixed medicine or the mixed chemical.

Of course, when mixtures are prepared by manufacturers at factories and are marketed in a bottled state, in place of allowing users to mix additives with bottled materials to prepare mixtures just before drinking or using the mixtures, it is possible to avoid the above-described problems experienced in the mixing of the additives with the bottled materials performed by the users. However, the mixtures which are prepared by the manufacturers and marketed in the bottled state are problematic in that the properties of ingredients of the bottled mixtures may be gradually degraded as time goes by, in addition to change in colors of the mixtures. Furthermore, the bottled mixtures may generate floating matters and deposits therein with passage of time.

In addition, it can be nearly impossible or extremely difficult to contain two or more kinds of different additives in a bottle, thereby being inconvenient to users while drinking or using the mixtures. Thus, it is necessary to provide a means capable of overcoming such inconvenience of the users.

SUMMARY OF THE INVENTION

Accordingly, the present invention has been made keeping in mind the above problems occurring in the prior art, and an object of the present invention is to provide a cap device for bottles, which is capable of mixing an additive contained therein with a bottled material to prepare a mixture in accordance with a simple rotating action of the cap device relative to a bottle, performed by a user, thereby allowing the user to easily prepare the mixture just before drinking or using the mixture, and overcoming the problems of degradation in the properties of ingredients, change in colors, and the generation of floating matters and deposits experienced in conventional bottled mixtures marketed in a bottled state, and which allows the user to mix a precise amount of the additive with the bottled material to prepare the mixture, thus preventing change in the taste and quality of the mixture in the case of preparing a mixed beverage through the mixing, and preventing incomplete dissolution of effective ingredients of the additive in the bottled material or a failure of accomplishment of desired medical or chemical effects of the mixture in the case of preparing a mixed medicine or a mixed chemical through the mixing, and which allows the user to be free from inconvenience caused by separate purchasing and handling of a conventional additive container and bottle.

Another object of the present invention is to provide a cap device for bottles, which contains two or more kinds of different additives therein when necessary, thus being more effectively and conveniently used, in comparison with a cap device containing one kind of additive.

In order to accomplish the above objects, the present invention provides a cap device for bottles, comprising: a cap cover acting as an additive containing part, and defining a cavity therein, with a partition wall provided in the cavity to divide the cavity into two chambers and to separately contain two different additives in the chambers; a first funnel part provided at a lower section of the cap cover; a breakable sheet having a structure to be easily broken by external impact provided at an open lower end of the first funnel part to close the open lower end of the first funnel part; a cap body assembled with a lower end of the cap cover, and externally tightened to an externally threaded mouth of a bottle; a second funnel part having the same shape as the first funnel part, and provided at an upper section of the cap body, such that the first and second funnel parts are spaced apart from each other or come into contact with each other; and a means for breaking the breakable sheet so as to open the lower end of the first funnel part.

In the cap device, the breaking means comprises two breaking wedges which project upward from a support part to a predetermined height through a central opening of the second funnel part and have sharp tips, the support part being formed in an upper section of the cap body at a position under the second funnel part.

The cap device further comprises a removable stop band placed around a junction of the cap body and the cap cover to stop the cap cover.

The stop band is preferably provided with a weak portion at a predetermined position thereof, so that the user easily breaks the stop band, when necessary.

BRIEF DESCRIPTION OF THE DRAWINGS

The above and other objects, features and other advantages of the present invention will be more clearly understood from the following detailed description taken in conjunction with the accompanying drawings, in which:

FIG. 1*a* is an exploded perspective view showing the construction of a cap device for bottles, according to an embodiment of the present invention;

FIG. 1*b* is a perspective view of the cap device of FIG. 1*a*, when the assembled cap device is tightened to the mouth of a bottle;

DETAILED DESCRIPTION OF THE INVENTION

Figure 2:
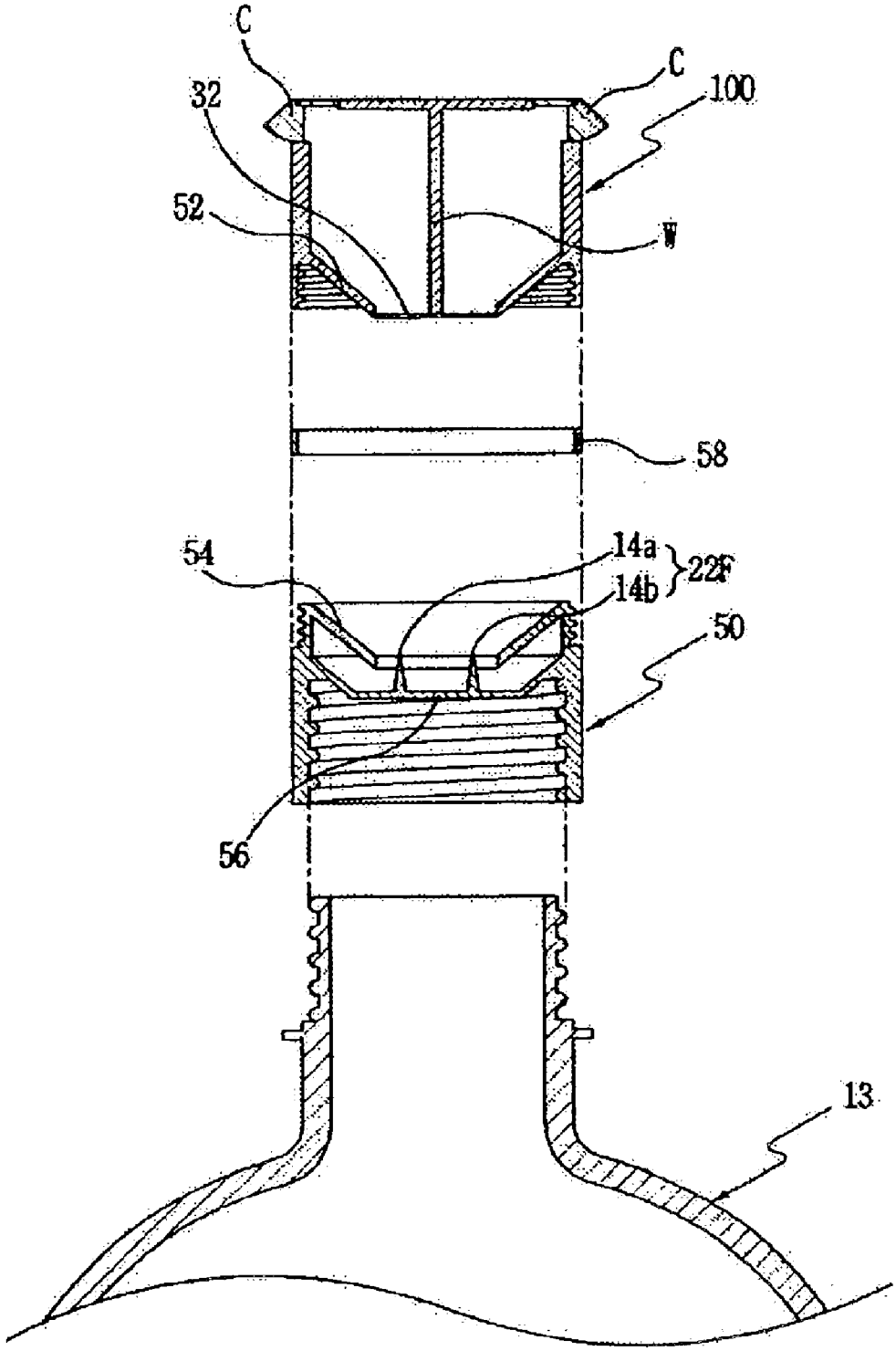
FIG. 2 is an exploded sectional view showing the construction of the cap device of FIG. 1*a*.

Reference should now be made to the drawings, in which the same reference numerals are used throughout the different drawings to designate the same or similar components.

FIGS. 1*a*, 1*b*, 2, 3*a*, and 3*b* are views showing a cap device for bottles, according to an embodiment of the present invention. As shown in the drawings, the cap device according to the embodiment of the present invention comprises a cap cover 100 acting as an additive containing part. The cap cover 100 has a first funnel part 52, and a breakable sheet 32 provided at an open lower end of the first funnel part 52 to close the open lower end of the first funnel part 52. The cap device also has a cap body 50 assembled with the cap cover 100. The cap body 50 has a second funnel part 54 and a breaking means 22F. The breaking means 22F acts as a valve means to break the breakable sheet 32 and thereby open the lower end of the first funnel part 52.

That is, the cap cover 100 has the first funnel part 52 at a lower section thereof, and forms a cavity therein to contain additives. The cavity defined in the cap cover 100 is divided into two chambers by a partition wall "W", thus separately containing two different additives in the divided chambers, as desired.

The breakable sheet 32, having a structure to be easily broken by external impact, is provided at the open lower end of the first funnel part 52 of the cap cover 100 to close the open lower end of the first funnel part 52. The second funnel part 54, which corresponds to the shape of the first funnel part 52, is provided at an upper section of the cap body 50, such that the fist and second funnel parts 52 and 54 may be spaced apart from each other in a non-usage position as shown in FIG. 3*a* or come into substantial contact with each other in response to a complete twisting of the cap cover 100 in a first predetermined direction relative to the cap body 50.

The cap body 50 is assembled at an externally threaded upper end thereof with an internally threaded lower end of the cap cover 100 through a screw-type engagement. The cap body 50 also has internal threads at a lower portion thereof, and is externally tightened to the externally threaded mouth of a bottle 13.

The breaking means 22F acting as the valve means is provided in the cap body 50 at a position under the second funnel part 54, such that the breaking means 22F projects upward from a support part 56 to a predetermined height through a central opening of the second funnel part 54. In the embodiment shown, the breaking means 22F comprises two breaking wedges 14*a* and 14*b*, which project upward from the support part 56 to the predetermined height through the central opening of the second funnel part 54. The wedges 14*a* and 14*b* have sharp tips sufficient to pierce the breakable sheet of the first funnel part 52. The support part 56 is integrally formed in the upper section of the cap body 50 at a position under the second funnel part 54.

Figure 3A:
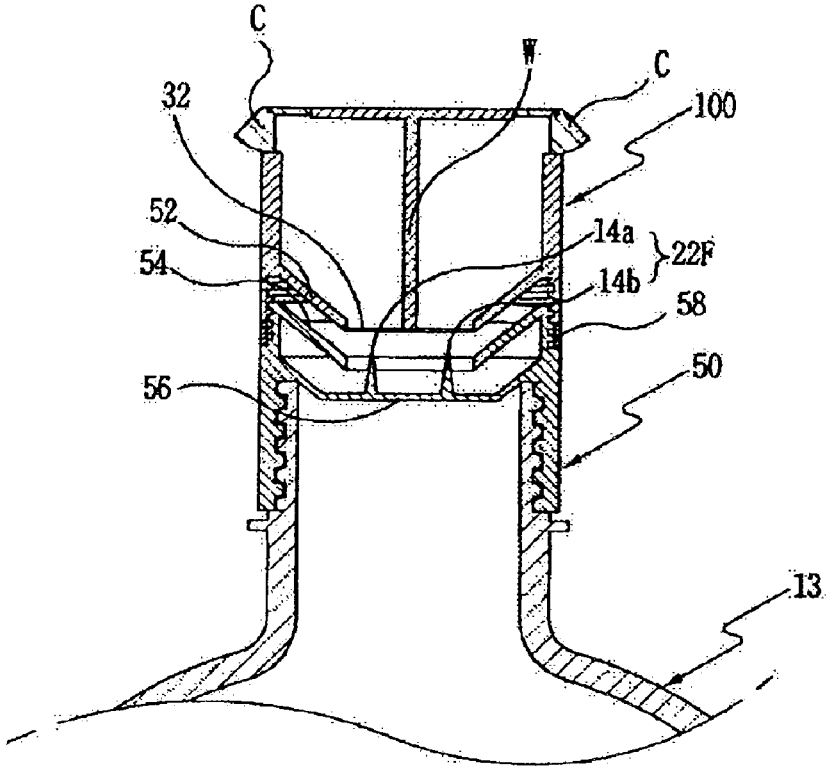
FIGS. 3*a* and 3*b* are sectional views showing the operation of the cap device of FIG. 1*b*.
Figure 3B:
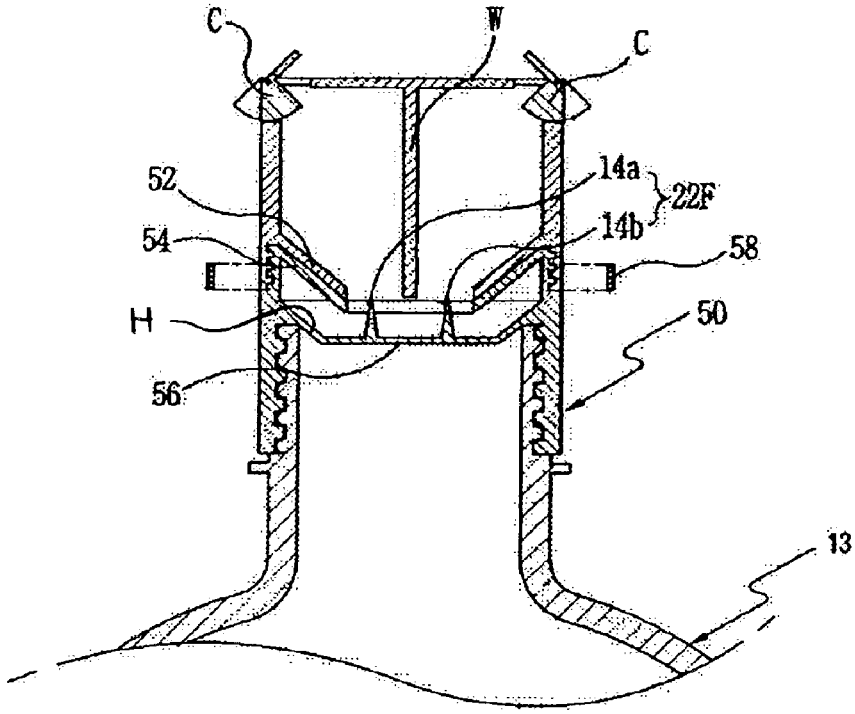

When the cap cover 100 is rotated in the first predetermined direction to move downward relative to the cap body 50 towards a mixing position of the cap device, as shown in FIGS. 3*a* and 3*b*, the breaking wedges 14*a* and 14*b* are inserted into the breakable sheet 32 provided at the lower end of the first funnel part 52, thus breaking the breakable sheet 32 and opening the lower end of the first funnel part 52. The two additives are thus discharged from the two separate chambers of the cap cover 100 into the bottle 13 under the guide of the first funnel part 52, so that the additives are mixed with the bottled material to prepare a desired mixture in the bottle 13.

A removable stop band 58 is preferably placed around the junction of the cap body 50 and the cap cover 100 so as function as a stop mechanism to prevent the cap cover 100 from being undesirably rotated to move downward relative to the cap body 50 before the user consciously rotates the cap cover 100 to mix the additives with the bottled material. The stop band essentially secures the cap device in the non-usage position and prevents unwanted movement to the mixed position.

The stop band 58 is preferably provided with a weak portion at a predetermined position thereof, so that the user easily breaks the stop band 58, when necessary.

The stop band 58 thus acts as a stop means for holding the cap cover 100 and prevent movement thereof before the user twists the cap device to mix the additive with the bottled material.

In the cap device according to the embodiment of the present invention, a vacuum pressure may act on the surfaces of the additives contained in the separate chambers of the cap cover 100 when the cap cover 100 is completely closed. In such a case, the additives cannot smoothly flow from the chambers of the cap cover 100 into the bottle 13 even when the chambers communicate with the interior of the bottle 13 by an operation of the breaking means 22F. In order to allow the additives to smoothly flow from the chambers into the bottle 13 in response to the communication of the chambers with the interior of the bottle 13, a small vent hole provided with a valve cock "C" to open or close the vent hole is formed at the top surface of the cap cover 100 at a position corresponding to each of the chambers. When the valve cocks "C" open the vent holes, atmospheric air is introduced into the chambers of the cavity through the open vent holes, thereby removing the vacuum pressure from the surfaces of the additives in the chambers. The additives thus smoothly flow from the chambers into the bottle 13, so that the additives are easily added to the material in the bottle 13 to produce a desired mixture.

As described above, the present invention provides a cap device for bottles, which is capable of mixing an additive contained therein with a bottled material to prepare a mixture in accordance with a simple rotating action of the cap device relative to a bottle, performed by a user, thereby allowing the user to easily prepare the mixture just before drinking or using the mixture. The cap device of the present invention allows the additive and the bottled material to be maintained in pure states without being mixed together before a user adds the additive to the bottled material by rotating the cap device relative to a mouth of the bottle. The cap device is thus free from physical or chemical problems of degradation in the properties of ingredients, change in colors, and a generation of floating matters and deposits experienced in conventional bottled mixtures marketed in a bottled state.

In addition, the cap device of the present invention allows the additive and the bottled material to be stored in separate states, and allows the user to mix a precise amount of the additive with the bottled material to prepare the mixture. Thus, the cap device does not force the user to separately purchase and handle an additive container and the bottle, and is convenient to the user.

The cap device is also free from excessive consumption of natural resources due to the separate production of the containers for additives and the capped bottles. Since the cap device allows the user to mix the precise amount of the additive with the bottled material to prepare the mixture, it is possible to prevent change in the taste and quality of the mixture in the case of preparing a mixed beverage through the mixing, and to prevent incomplete dissolution of effective ingredients of the additive in the bottled material or a failure of accomplishment of desired medical or chemical effects of the mixture in the case of preparing a mixed medicine or a mixed chemical through the mixing.

In addition, the cap device of the present invention can contain two or more kind of different additives therein when necessary, thus being more effectively and conveniently used, in comparison with a cap device containing one kind of additive.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A cap device for a bottle, said cap device comprising:

a cap cover defining a cavity therein for containing an additive therein;

a partition wall provided in the cavity to divide the cavity into two chambers, each chamber capable of containing an additive therein;

a first funnel part provided at a lower section of the cap cover, said first funnel part having an open lower end;

a breakable sheet provided at the lower end of the first funnel part to cover the open lower end of the first funnel part; said breakable sheet structured to be easily broken by external impact;

a cap body removably assembled to a lower end of the cap cover, said cap body removably connected to said bottle;

a second funnel part provided at an upper section of the cap body;

wherein the first and second funnel parts are spaced apart from each other in a non-usage position of the cap device;

wherein the first and second funnel parts move substantially close together when said cap cover is twisted in a first predetermined direction to move the cap device to a mixing position; and, means for breaking the breakable sheet so as to open the lower end of the first funnel part.

2. The cap device for a bottle according to claim 1 further comprising a support part disposed in said cap body below said second funnel part;

wherein the breaking means comprises two breaking wedges projecting upward from said support part to a predetermined height through a central opening of the second funnel part, each breaking wedges having a sharp tip.

3. The cap device for a bottle according to claim 1, further comprising a removable stop band placed around a junction of the cap body and the cap cover so as to stop the cap cover from being twisted in the first predetermined direction.

4. The cap device for a bottle according to claim 1 wherein the bottle has an externally threaded mouth and wherein said cap body has an internally threaded lower section for external twistable engagement with said threaded mouth of said bottle.

5. A bottle having a mouth, said bottle comprising:

a cap cover defining a cavity therein for containing an additive therein;

a partition wall provided in the cavity to divide the cavity into two chambers, each chamber capable of containing an additive therein;

a first funnel part provided at a lower section of the cap cover, said first funnel part having an open lower end;

a breakable sheet provided at the lower end of the first funnel part to cover the open lower end of the first funnel part; said breakable sheet structured to be easily broken by external impact;

a cap body removably assembled to a lower end of the cap cover, said cap body removably connected to said bottle;

a second funnel part provided at an upper section of the cap body;

wherein the first and second funnel parts are spaced apart from each other in a non-usage position of the cap device;

wherein the first and second funnel parts move substantially close together when said cap cover is twisted in a first predetermined direction to move the cap device to a mixing position; and, means for breaking the breakable sheet so as to open the lower end of the first funnel part.

6. The bottle according to claim 5 further comprising a support part disposed in said cap body below said second funnel part;

wherein the breaking means comprises two breaking wedges projecting upward from said support part to a predetermined height through a central opening of the second funnel part, each breaking wedges having a sharp tip.

7. The bottle according to claim 5, further comprising a removable stop band placed around a junction of the cap body and the cap cover so as to stop the cap cover from being twisted in the first predetermined direction.

8. The bottle according to claim 5 wherein the bottle has an externally threaded mouth and wherein said cap body has an internally threaded lower section for external twistable engagement with said threaded mouth of said bottle.

* * * * *